United States Patent [19]

Hanson

[11] 4,282,660

[45] Aug. 11, 1981

[54] LEG-SIZE ADJUSTING FORM FITTING BOOT

[75] Inventor: Chris A. Hanson, Boulder, Colo.

[73] Assignee: Hanson Industries Incorporated, Boulder, Colo.

[21] Appl. No.: 123,048

[22] Filed: Feb. 20, 1980

[51] Int. Cl.[3] ..... A43B 5/04

[52] U.S. Cl. ..... 36/121

[58] Field of Search ..... 36/117, 118, 119, 120, 36/121

[56] References Cited

U.S. PATENT DOCUMENTS

| | | | |
|---|---|---|---|
| 3,945,135 | 3/1976 | Hanson et al. | 36/121 |
| 3,988,842 | 11/1976 | Rathmell | 36/121 |

FOREIGN PATENT DOCUMENTS

| | | | |
|---|---|---|---|
| 2262453 | 2/1974 | Fed. Rep. of Germany | 36/121 |

*Primary Examiner*—Patrick D. Lawson

*Attorney, Agent, or Firm*—Merriam, Marshall & Bicknell

[57] ABSTRACT

An improved custom fitted ankle-covering boot, such as for sportswear, including a substantially rigid shell, a substantially rigid rear tongue member extending upwardly from the shell along the back of the wearer's lower leg, an elongated, curved tab with a lower portion adpated for insertion around the instep area and an upper portion extending in the area of the lower leg front opposite from the rear tongue member. A slit is provided at the top of the upper tab portion extending downwardly towards the lower tab portion. Adjustable threaded means extend across the slit to vary the slit width and thereby enable conformance of the upper boot with the lower leg size of the wearer.

5 Claims, 3 Drawing Figures

LEG-SIZE ADJUSTING FORM FITTING BOOT

This invention relates to ankle-covering boots suitable for use in sports footwear, such as custom fitted ski boots and to improvements therein to enable sizing of the wearer's foot and leg to the boot.

BACKGROUND OF THE INVENTION

Reference may be made to the following U.S. Pat. Nos. of interest: 3,798,799; 3,882,561 and 4,083,127, all assigned to the same assignee as herein.

In ankle-covering boots for sports footwear, such as custom fitted ski boots and ice skates, it is desired to have the boot and its components adapted to surround and be contoured to custom-fit the wearer's foot. In such cases, the boot is to provide a support function for the wearer's foot and ankle and enable firm contact to be maintained between the foot and the outer shell of the ski boot.

Reference may be made to the aforementioned U.S. Pat. Nos. 3,798,799 and 3,882,561 wherein the custom fitting operation is disclosed. The aforementioned U.S. Pat. No. 4,083,127 additionally discloses the use of pressure-compensating fitting material used as fitting pads in conjunction with ski boots to maintain a snug or firm fitting relationship with the skier's foot during use to provide protection or comfort by cushioning against pressure, impact or shock. Additionally, in view of the required substantially non-compressable stiff plastic material forming the shell of such boots, means may be provided on the boot to achieve adjustment in the normal boot stiffness, such adjustment being shown for instance in U.S. Pat. No. 4,083,127.

It is also desired to provide a custom fitted ankle-covering boot with means for adjusting the upper boot portion in the area between the wearer's ankle and leg shins so as to conform to his lower leg size. While the lower stiff boot shell portion covering the foot and ankle area may contain the aforementioned adjustment for stiffness, the boot portion above the lower shell, in the area of the lower leg shins, is more flexible and normally not adjustable in size. Thus, it is desired to provide a means for adjusting this boot portion so as to enable a wearer to obtain a better custom fit and accommodate any variations in foot and lower leg sizes.

SUMMARY OF THE INVENTION

An elongated, curved plastic tab having a slit at the top end is formed so that it can be inserted into the boot front and extend from the ankle area upwardly to the lower leg. A thin walled bottom portion of the tab extends into the stiff lower boot shell portion and is secured thereto in the ankle area. A thick walled upper tab portion extends upwardly to the lower leg area above the relatively stiff boot shell portion and includes a slit extending downwardly towards the bottom tab portion.

Adjustably threaded means are provided to extend through the tab slit and on either side thereof. A threaded screw member engages a pair of recessed walls bordering the slit, and can be adjusted so as to narrow or enlarge the slit. This enables the wearer to readily adjust the upper portion of the boot to conform to his lower leg size.

DETAILED DESCRIPTION

Figure 1:
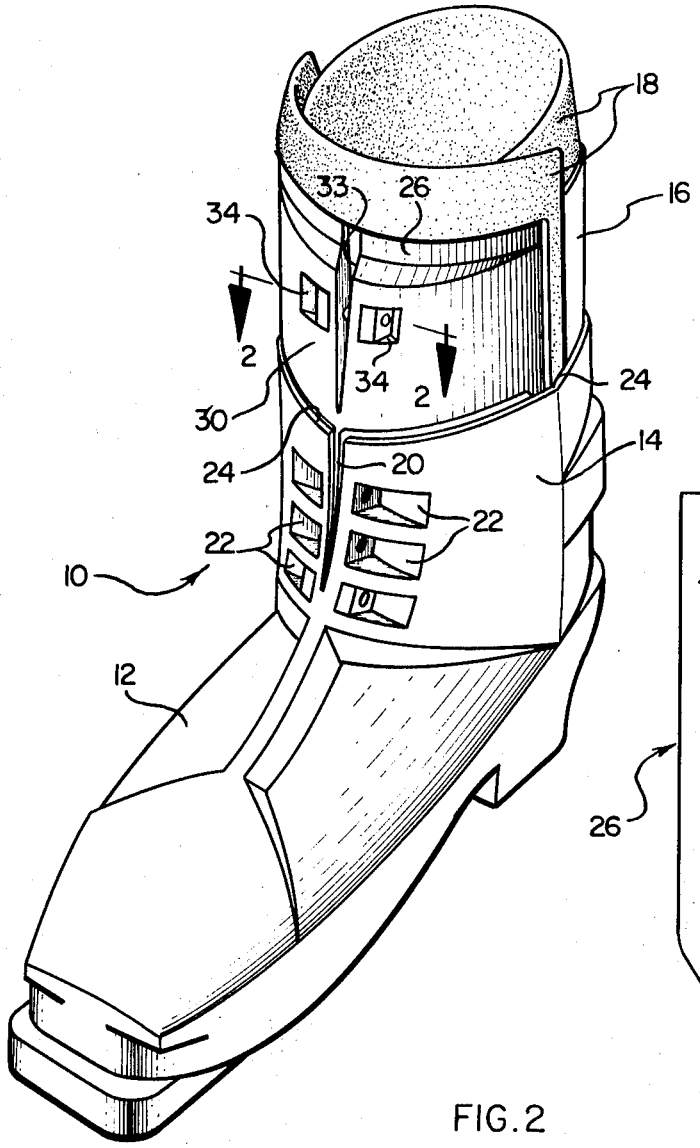
FIG. 1 is a perspective view of a custom fitted ski boot with an adjustable slit in a plastic tab insert at the upper portion of the boot.
Figure 3:
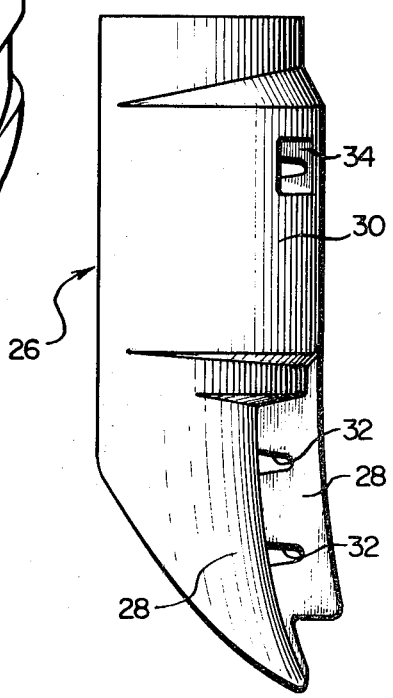
FIG. 3 is a perspective view of the plastic tab insert with a bottom portion for connection to the lower, stiff boot shell and an upper, thicker walled portion containing the aforementioned leg size adjustment.

Referring now to FIG. 1, there is illustrated a ski boot 10 having a substantially rigid outer shell 12 which includes an upper instep portion 14 extending in the area of the wearer's ankles. The boot 10 is of the rearentry type having a pivoting rear tongue member 16 formed of the same material as the shell 12. As is known, tongue 16 pivots outwardly away from the shell to allow entry of the wearer's foot into the boot. The tongue 16 is then pivoted back into its closed position and secured in place by fastening means such as buckles.

Reference may be made for instance to the aforementioned U.S. Pat. Nos. 3,798,799 and 3,882,561 which disclose rear-entry ski boots of the type shown in FIG. 1 which include the plastic outer shell 12, rear tongue 16, and a substantially flexible, inner liner 18 (that is, polyurethane foam) disposed therein. The aforementioned patents are disclosed a custom fitting operation to provide a custom fit of the boot to the shape of the foot. The upper instep shell portion 14 includes a slit 20 and a series of recesses 22 on either side of the slit. This enables a skier to position a threaded screw and locking nut in place in any one of the three sets of aligned apertures so that the skier may select or change the amount of flex in the boot as described in the aforementioned U.S. Pat. No. 4,083,127, much in the manner provided by the ski boot disclosed in U.S. Pat. No. 3,848,347.

As shown in FIG. 1, the upper portion of rear tongue 16 extends upwardly above the top 24 of instep shell portion 14. The upper extension of tongue 16 extends around the back of the skier's lower leg. In accordance with the present invention, there is provided an elongated, curved tab insert 26 which includes a thin walled lower portion 28 generally curved to conform to the instep area and a thicker walled upper portion 30 generally curved to conform to the lower leg area. Tab 26 is formed of the same substantially rigid, plastic material as outer shell 12. Lower tab portion 28 includes a plurality of apertured fins 32 so that upon insertion of the lower portion 28 within the boot, the fins 32 will be aligned with a respective paired recess 22 in the instep portion 14. Placing threaded screw means into a selected one of the recesses secures tab 26 into the boot.

Thick walled upper portion 30 projects outwardly from the top 24 of instep 14 so as to be placed on the front of the skier's leg and directly opposite from the projecting rear tongue 16. As shown in FIG. 1, thick walled portion 30 includes a slit 33 extending downwardly from the top of the tab towards the lower portion, but terminating prior to reaching the thin walled lower portion. A pair of aligned recesses 34 on opposite sides of the slit 33 include a suitable aperture for insertion of a threaded screw 36.

Figure 2:
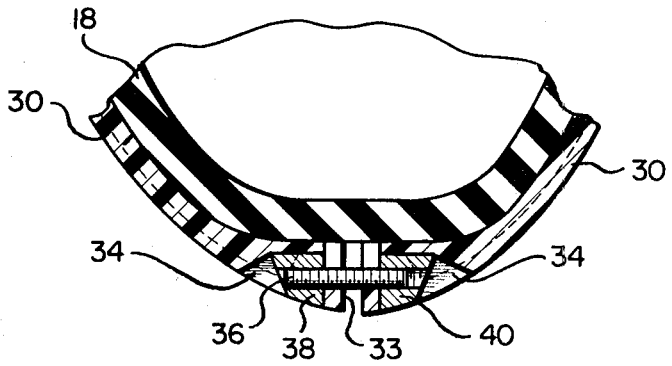
FIG. 2 is a fragmented sectional view taken along section lines 2—2 of FIG. 1 illustrating the threaded means for adjusting the slit size to conform the upper boot portion to a wearer's lower leg size.

As most clearly shown in FIG. 1 and the sectional view of FIG. 2, tab upper portion 30 has a somewhat thicker wall section at slit 33, with the wall section tapering and becoming thinner towards each side of tab 26 away from the slit. A backing member 38 having a suitable aperture to accommodate threaded screw 36 is placed in one recess 34 on one side of slit 33. A similar backing member 40 includes a theaded aperture and is placed on the opposite recess along side slit 33. Threaded screw 36 may then be inserted through backing member 38 and adjustably threaded into backing member 40. Backing member 40 acts as a locking nut to maintain the screw position for the desired slit size. The wearer may thus adjust the position of threaded screw 36 to narrow or widen the slit 33 and thereby tighten or loosen the upper boot portion so as to conform it more closely to the wearer's lower leg size.

While particular embodiments of the present invention have been shown and described, it will be obvious to those skilled in the art that various changes and modifications may be made without departing from the invention in its broader aspects. Accordingly, the aim of the appended claims is to cover all such changes and modifications as may fall within the true spirit and scope of the invention.

What is claimed is:

1. In a boot that includes a substantially rigid shell for covering at least to the ankle of the wearer, and a substantially rigid rear tongue member extending upwardly from the shell along the back of the wearer's lower leg, the improvement comprising:

an elongated, substantially rigid, curved tab member having a thin lower portion adapted for insertion into said boot shell in the instep area and a thick walled upper portion extending from the top of said shell in the area of the front of the wearer's lower leg opposite said substantially rigid rear member;

means for securing said tab lower portion to said shell;

said tab upper portion including a slit extending downwardly from the top of said thick walled tab upper portion; and adjustable threaded means on said thick walled tab upper portion extending across said slit to vary the width of said slit in conformance with the lower leg size of said wearer.

2. The improvement of claim 1, wherein said tab upper portion includes a tapered wall section thicker at said slit and thinner at the sides of said tab upper portion away from said slit.

3. The improvement of claim 2, including a pair of aligned recesses in said tab upper portion on either side of said slit, an aperture extending through each recess, and threaded screw means insertable into said recesses for adjustably varying the width of said slit.

4. The improvement of claim 3 wherein said threaded screw means includes a threaded screw extending through said apertures.

5. The improvement of claim 4, wherein said threaded screw means includes a locking nut in one of said recesses threadably engaging said threaded screw.

* * * * *